US008438668B2

(12) United States Patent
Garneau et al.

(10) Patent No.: US 8,438,668 B2
(45) Date of Patent: May 14, 2013

(54) OCCIPITAL STABILIZATION STRAP FOR HELMETS

(75) Inventors: Louis Garneau, St-Augustin-de-Desmaures (CA); Dominic Hamel, Saint Ferreol les Neiges (CA); Paul Isabelle, St-Augustin-de-Desmaures (CA)

(73) Assignee: Louis Garneau Sports Inc. (CA)

( * ) Notice: Subject to any disclaimer, the term of this patent is extended or adjusted under 35 U.S.C. 154(b) by 263 days.

(21) Appl. No.: 12/781,158

(22) Filed: May 17, 2010

(65) Prior Publication Data

US 2011/0277222 A1 Nov. 17, 2011

(51) Int. Cl.
*A42B 7/00* (2006.01)

(52) U.S. Cl.
USPC ..... 2/421

(58) Field of Classification Search ..... 2/2.5, 6.6, 2/421

See application file for complete search history.

(56) References Cited

U.S. PATENT DOCUMENTS

| | | | | |
|---|---|---|---|---|
| 2,814,043 | A | | 11/1957 | Alesi |
| 2,846,683 | A | | 8/1958 | Dye et al. |
| 3,354,468 | A | | 11/1967 | Bowers, Jr. |
| 3,418,657 | A | | 12/1968 | Lastnik et al. |
| 3,591,863 | A | | 7/1971 | Rickard |
| 3,714,668 | A | | 2/1973 | Mirabella |
| 3,852,821 | A | | 12/1974 | Mickel |
| 4,000,520 | A | | 1/1977 | Svendsen |
| 4,075,715 | A | | 2/1978 | Cowgill |
| 4,263,679 | A | * | 4/1981 | Erlendson ..... 2/421 |
| 4,703,879 | A | | 11/1987 | Kastendieck |
| 4,753,378 | A | * | 6/1988 | Kastendieck et al. ..... 224/181 |
| 4,805,239 | A | | 2/1989 | Ciago |
| 4,884,301 | A | | 12/1989 | Aileo |
| 4,885,806 | A | | 12/1989 | Heller |
| 4,897,888 | A | | 2/1990 | Broersma et al. |
| 4,898,162 | A | | 2/1990 | Worthrich |
| 4,901,373 | A | | 2/1990 | Broersma |
| 5,044,019 | A | | 9/1991 | Shewchenko et al. |
| 5,088,130 | A | | 2/1992 | Chiarella |
| 5,091,997 | A | | 3/1992 | Foehl |
| 5,099,523 | A | | 3/1992 | Broersma |
| 5,121,508 | A | | 6/1992 | Grilliot |
| 5,179,735 | A | | 1/1993 | Thomanek |
| 5,315,718 | A | | 5/1994 | Barson |
| 5,337,421 | A | | 8/1994 | Jeng |
| 5,351,341 | A | | 10/1994 | Broersma |
| 5,381,560 | A | | 1/1995 | Halstead |

(Continued)

FOREIGN PATENT DOCUMENTS

| | | |
|---|---|---|
| CA | 2356721 | 2/2003 |
| DE | 9003305 | 5/1990 |

(Continued)

*Primary Examiner* — Katherine Moran
(74) *Attorney, Agent, or Firm* — Cantor Colburn LLP

(57) ABSTRACT

A stabilization strap apparatus for a helmet having a shell with at least one chin strap having a left section and a right section connected to the shell, includes an adjusting assembly shaped to fit a rear occipital portion of a wearer's cranium; and a left occipital strap section and a right occipital strap section, each strap section having a first end securable respectively to the left section and the right section of the at least one chin strap, downwardly of and spaced-apart from the casket shell and a second end slidably attached to the adjusting assembly.

22 Claims, 5 Drawing Sheets

U.S. PATENT DOCUMENTS

| | | | | |
|---|---|---|---|---|
| 5,437,064 | A | 8/1995 | Hamaguchi | |
| 5,450,631 | A | 9/1995 | Egger | |
| 5,481,762 | A | 1/1996 | Gentes | |
| D372,559 | S | 8/1996 | Murakami | |
| 5,551,094 | A | 9/1996 | Navone | |
| D375,582 | S | 11/1996 | Garneau | |
| 5,581,819 | A | 12/1996 | Garneau | |
| 5,617,589 | A | 4/1997 | Lacore et al. | |
| 5,619,754 | A | 4/1997 | Thurwanger | |
| 5,619,756 | A | 4/1997 | Garneau | |
| 5,638,551 | A | 6/1997 | Lallemand | |
| D388,551 | S | 12/1997 | Lu | |
| 5,704,072 | A | 1/1998 | Garneau | |
| 5,734,994 | A | 4/1998 | Rogers | |
| 5,813,055 | A | 9/1998 | Egger | |
| 5,833,796 | A | 11/1998 | Matich | |
| 5,898,950 | A * | 5/1999 | Spyrou et al. | 2/421 |
| D411,337 | S | 6/1999 | Schultz | |
| D411,338 | S | 6/1999 | Egger et al. | |
| 5,983,405 | A * | 11/1999 | Casale | 2/421 |
| D426,677 | S | 6/2000 | Ho | |
| 6,550,071 | B2 | 4/2003 | Garneau | |
| 7,114,197 | B2 | 10/2006 | Garneau | |
| 7,234,210 | B2 | 6/2007 | Stiles et al. | |
| 7,565,704 | B2 | 7/2009 | Wu | |
| 7,827,617 | B2 * | 11/2010 | Trainor et al. | 2/6.6 |
| 2006/0179537 | A1 * | 8/2006 | Dennis et al. | 2/6.6 |

FOREIGN PATENT DOCUMENTS

| | | |
|---|---|---|
| DE | 9109328 | 10/1991 |
| EP | 0369187 | 5/1990 |
| EP | 0470746 | 2/1992 |
| EP | 0769256 | 4/1997 |
| EP | 0815755 | 1/1998 |
| EP | 0682885 | 6/2004 |
| GB | 1108502 | 4/1968 |
| WO | 9501739 | 1/1995 |

* cited by examiner

OCCIPITAL STABILIZATION STRAP FOR HELMETS

TECHNICAL FIELD OF THE INVENTION

The technical field relates to helmets for head protection and, more particularly, to an adjustable stabilization system for a helmet.

BACKGROUND

Helmets are worn by users carrying out activities that require head protection, such as cycling. Helmets, which come in various sizes and shapes, include a retention system including fastening straps that extend under the chin of the helmet wearer to retain the helmet in position with the wearer's head.

The fastening straps assist in maintaining the helmet attached to the wearer's head and reduce vertical and pivoting movements of the helmet. However, since they extend downwardly and forwardly under the chin, fastening straps may not always prevent a pivotal play toward the front of the wearer's head. This may result in exposing the back of the wearer's head during a multiple-impact fall.

Stabilizing straps, which contour the occipital portion of the wearer's head, have been developed (See for instance U.S. Pat. Nos. 5,704,072; 5,638,551; and 7,114,197). However, these stabilization straps are typically relatively heavy and there is always a need for lighter helmets.

BRIEF SUMMARY OF THE INVENTION

It is therefore an aim of the present invention to address the above mentioned issues.

According to a general aspect, there is provided a helmet comprising a shell shaped to fit a wearer's cranium and having a left side and a right side; at least one chin strap having a left section and a right section attached to the shell; and a stabilization strap including a left and a right lateral sections, each having a first end connected respectively to the left and the right sides of the shell and a second end attached respectively to the left and the right sides of the at least one chin strap, a left and a right occipital sections, each having a first end attached respectively to the left and the right sides of the at least one chin strap and a second end, and an adjusting assembly connecting the second ends of the left and the right occipital sections together.

In an embodiment, the second ends of the lateral sections are pivotally attached to a respective one of the first ends of the occipital sections. One of the second ends of the lateral sections and the first ends of the occipital sections can comprise a female member and the other one of the second ends of the lateral sections and the first ends of the occipital sections can comprise a corresponding male member insertable in the female member. The second ends of the lateral sections can comprise the male members and the first ends of the occipital sections can comprise the female members and wherein the male members can comprise a stem portion and a conically shaped protuberance extending from the stem portion and the female members can comprise an aperture defined in the first ends of the occipital sections.

In an embodiment, the second ends of the lateral sections and the first ends of the occipital sections are pivotally connected to the at least one chin strap.

In an embodiment, the left and the right sections of the at least one chin strap are substantially Y-shaped with a front branch attached to the shell and a rear branch attached to the shell in a spaced-apart relationship and the second ends of the lateral sections and the first ends of the occipital sections are attached to the rear branch of the at least one chin strap. The second ends of the lateral sections and the first ends of the occipital sections can be attached to the rear branch downwardly of and spaced-apart from the shell.

In an embodiment, the second ends of the left and the right occipital sections are slidably connected to the adjusting assembly for adjusting the length of the occipital sections.

According to another general aspect, there is provided a helmet comprising a shell shaped to fit a wearer's cranium and having a left side and a right side; at least one woven-fiber chin strap having a left section and a right section connected to the shell; and a stabilization strap including a left and a right occipital sections, each having a first end attached respectively to the left and the right sides of the at least one chin strap without substantially creating discontinuities in the at least one woven-fiber chin strap and a second end, and an adjusting assembly connecting the second ends of the left and the right occipital sections together.

In an embodiment, the stabilization strap comprises a left and a right lateral sections, each having a first end connected respectively to the left and the right sides of the shell and a second end attached respectively to the left and the right sides of the at least one chin strap.

In an embodiment, the second ends of the lateral sections are attached to a respective one of the first ends of the occipital sections. One of the second ends of the lateral sections and the first ends of the occipital sections can comprise a female member and the other one of the second ends of the lateral sections and the first ends of the occipital sections can comprise a corresponding male member insertable in the female member and in the at least one chin strap. The second ends of the lateral sections can comprise the male members and the first ends of the occipital sections can comprise the female members and wherein the male members comprise a stem portion and a conically shaped protuberance extending from the stem portion and the female members can comprise an aperture defined in the first ends of the occipital sections.

In an embodiment, the second ends of the lateral sections and the first ends of the occipital sections are pivotally connected to the at least one chin strap.

In an embodiment, wherein the left and the right sections of the at least one chin strap are substantially Y-shaped with a front branch attached to the shell and a rear branch attached to the shell in a spaced-apart relationship and the second ends of the lateral sections and the first ends of the occipital sections are attached to the rear branch. The second ends of the lateral sections and the first ends of the occipital sections can be attached to the rear branch downwardly of and spaced-apart from the shell.

In an embodiment, the second ends of the left and the right occipital sections are slidably connected to the adjusting assembly.

According to a further general aspect, there is provided a stabilization strap apparatus for a helmet having a shell with at least one chin strap having a left section and a right section connected to the shell, comprising: an adjusting assembly shaped to fit a rear occipital portion of a wearer's cranium; and a left occipital strap section and a right occipital strap section, each strap section having a first end securable respectively to the left section and the right section of the at least one chin strap, downwardly of and spaced-apart from the casket shell and a second end slidably attached to the adjusting assembly.

In an embodiment, the stabilization strap apparatus comprises a left lateral section and a right lateral section, each having a first end connected respectively to the left and the right sides of the shell and a second end attached respectively to the left and the right sides of the at least one chin strap.

In an embodiment, the second ends of the lateral sections are attached to a respective one of the first ends of the occipital sections. One of the second ends of the lateral sections and the first ends of the occipital sections can comprise a female member and the other one of the second ends of the lateral sections and the first ends of the occipital sections can comprise a corresponding male member insertable in the female member.

In an embodiment, the second ends of the lateral sections and the first ends of the occipital sections are pivotally connected to the at least one chin strap.

In an embodiment, the left and the right sections of the at least one chin strap are substantially Y-shaped with a front branch attached to the shell and a rear branch attached to the shell in a spaced-apart relationship and the second ends of the lateral sections and the first ends of the occipital sections are attached to the rear branch.

BRIEF DESCRIPTION OF THE DRAWINGS

It will be noted that throughout the appended drawings, like features are identified by like reference numerals.

DETAILED DESCRIPTION

Figure 1:
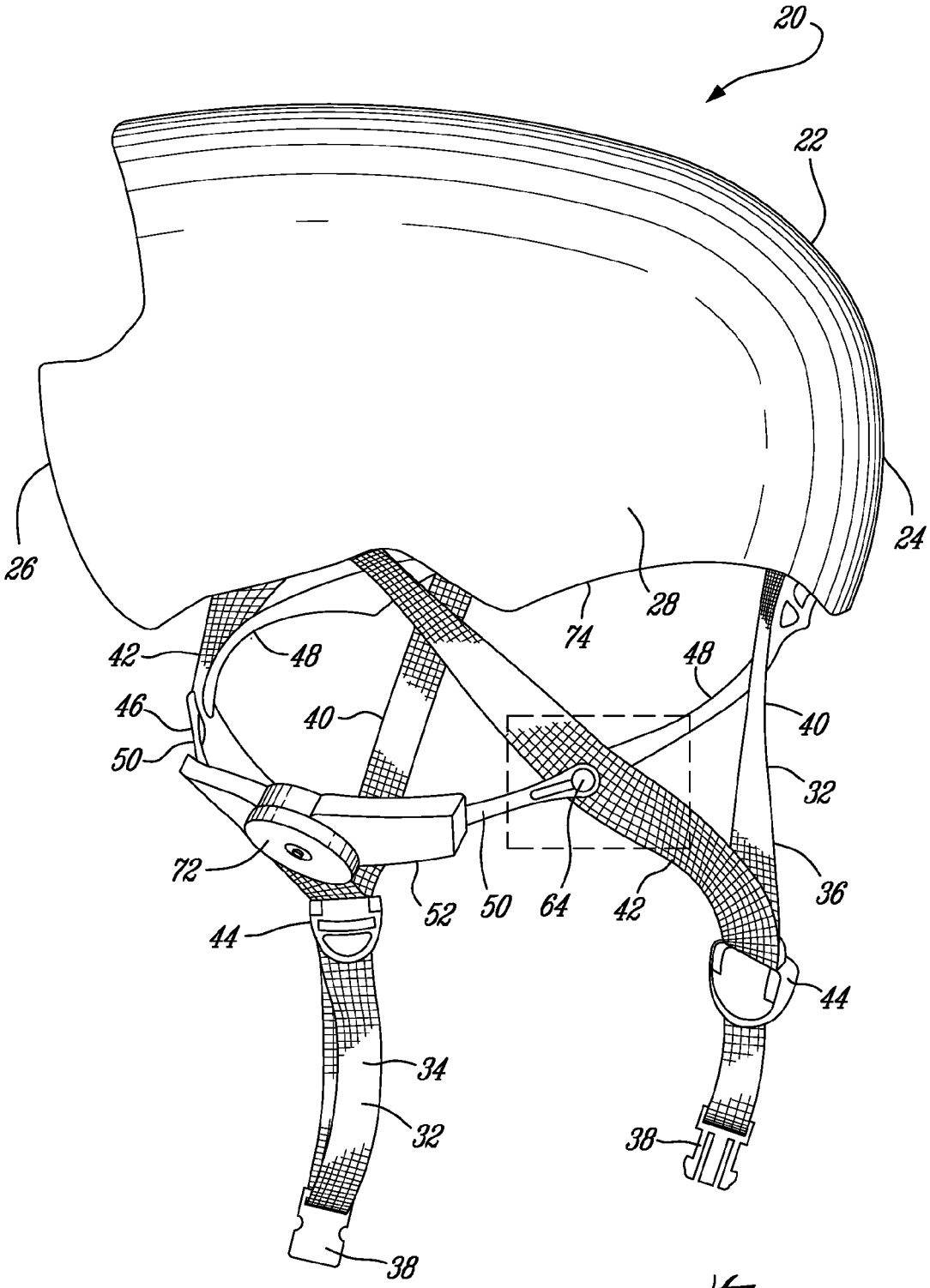
FIG. 1 is a rear perspective view of a helmet having a stabilization strap in accordance with an embodiment.
Figure 2:
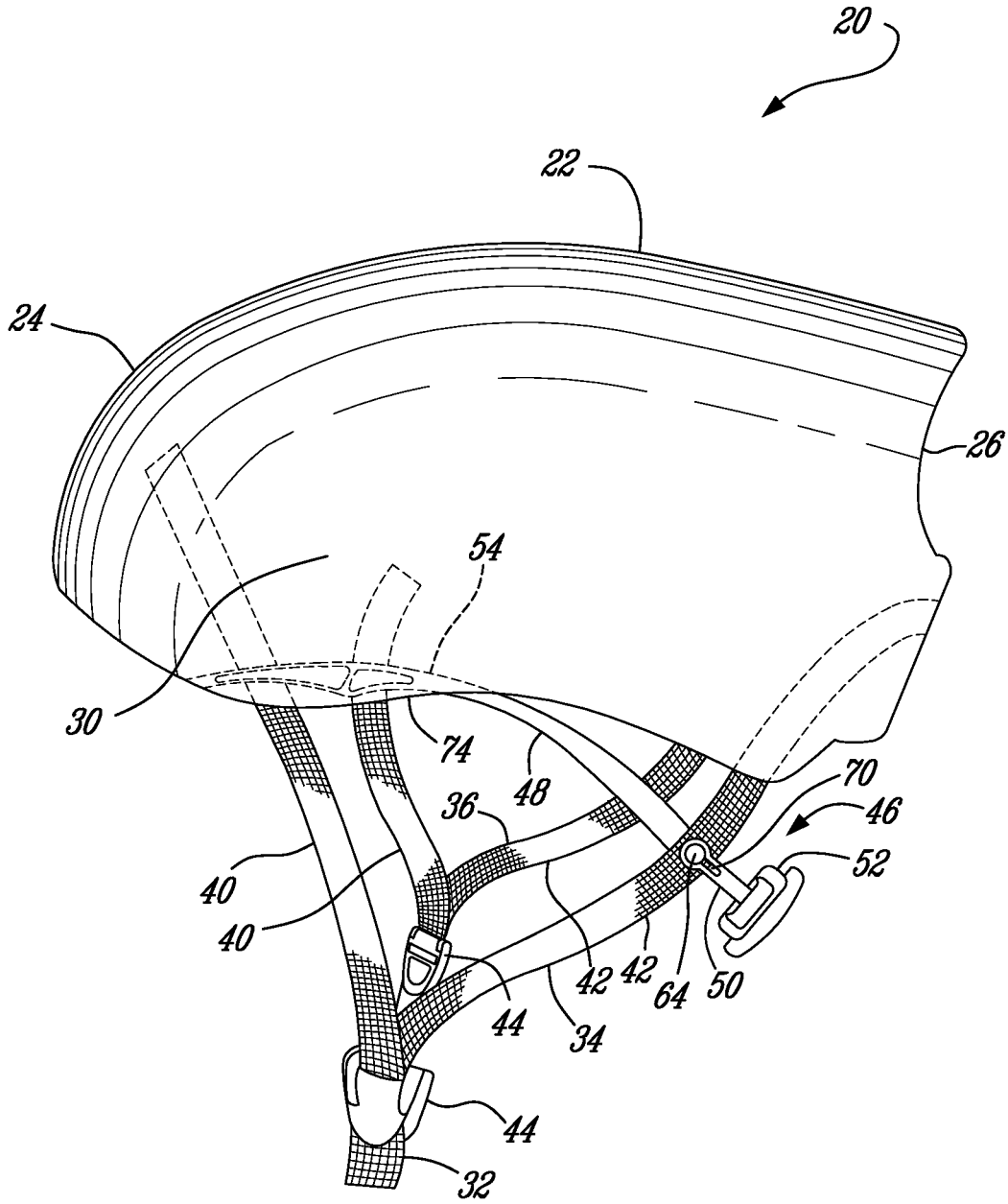
FIG. 2 is a side elevation view of the helmet having the stabilization strap shown in FIG. 1.

Referring now to the drawings and, more particularly, referring to FIGS. 1 and 2, there is shown a helmet 20 having a shell 22 with a front section 24, a rear section 26, a right side 28, and a left side 30. The shape of the shell 22 is designed to protect a wearer's cranium in case of a fall. In the embodiment shown, the helmet 20 is a cycling helmet.

The helmet 20 includes a retention system and, more particularly, a chin strap 32 which has a left section 34 and a right section 36, each being connected to a respective side of the helmet shell 22 and extending downwardly on the respective lateral side of the wearer's head. The free ends of the left and the right sections 34, 36 of the chin strap 32 are connectable to one another. More particularly, in the embodiment shown, they are equipped with a fast hooking/unhooking fastener 38 positioned beneath and spaced-apart from the shell 22. The left and the right sections 34, 36 of the chin strap 32 are connected to one another under the wearer's chin when worn.

In the embodiment shown the chin strap 32 is Y-shaped. Each one of the left and the right sections 34, 36 has a front branch 40 and a rear branch 42 joined together by a slidable strap divider or connector 44 as it is known in the art. The front and the rear branches 40, 42 of the chin strap 32 have an end attached to the helmet shell 22, extend respectively before and behind each of the ears, and connect under the ears. The chin strap 32 can be adjusted by moving the slidable strap divider 44 and the hooking/unhooking fastener 38 along the strap to secure and stabilize the helmet 20 to the wearer's head.

It is appreciated that, in an alternative embodiment (not shown), the left and the right sections 34, 36 of the chin strap 32 can include a single strap, instead of being Y-shaped. The strap can be attached to the helmet shell 22 close to the wearer's ears, or forwardly thereof.

In an alternative embodiment (not shown), the chin strap 32 can be single piece, i.e. the chin strap 32 can extend continuously in the helmet 20 from the left side 30 to the right side 28, with the free ends of the strap carrying a fastener, such as and without being limitative, the hooking/unhooking fastener 38, for securing the chin strap 32 under the wearer's chin.

In an embodiment, the chin strap 32 is made of woven fabric which allows limited or no stretching. For instance and without being limitative, the chin strap 32 can be made of nylon, polypropylene, or polyester.

The helmet 20 also has a stabilization system which includes a multi-pieces stabilization strap 46 secured to the helmet shell 22 and to the chin strap 32. The stabilization strap 46 includes a left and a right lateral sections 48, a left and a right occipital sections 50, and an adjusting assembly 52 connecting the left and the right occipital sections 50. The left and the right sections of the stabilization straps 46 being similar, only one section will be described in further details.

Figure 5:
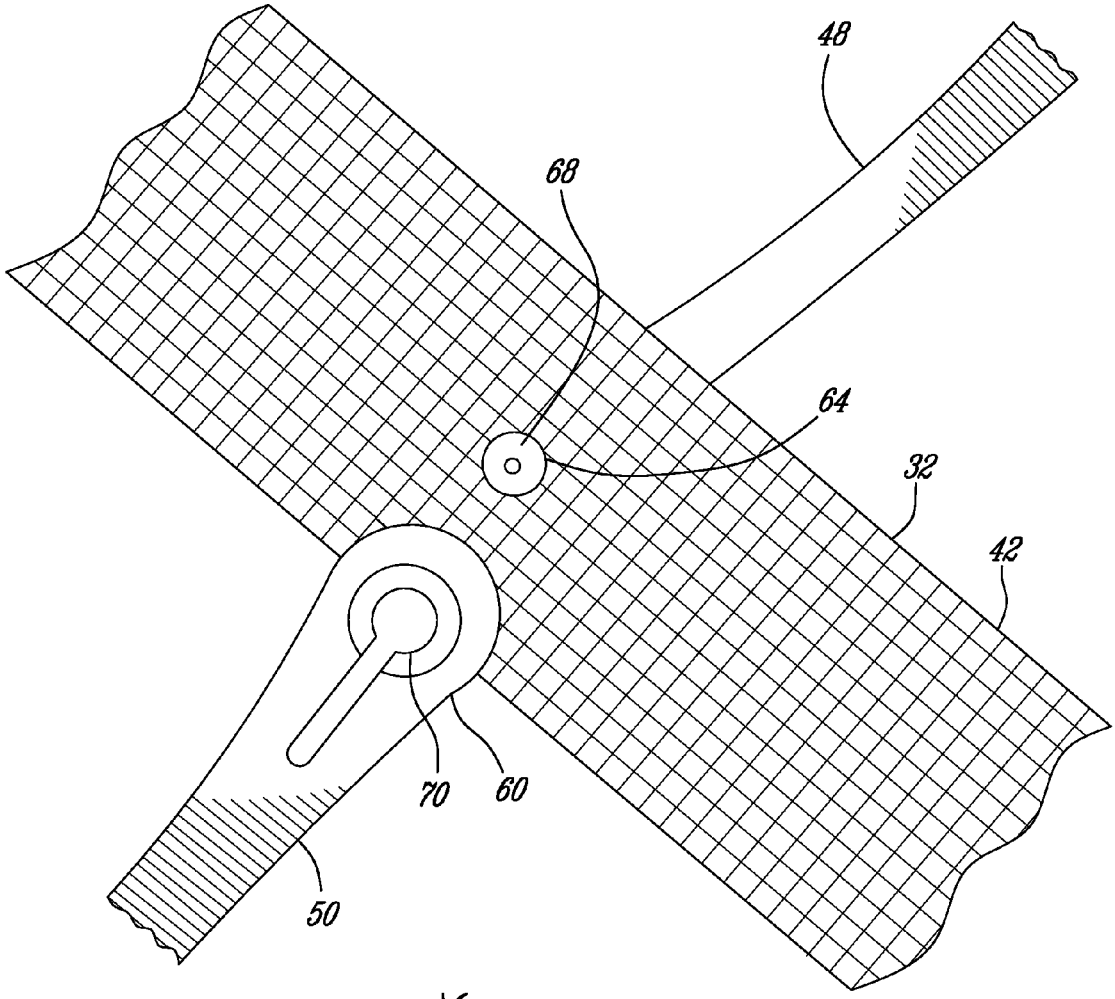
FIG. 5 is a side elevation view, enlarged, of the connection between the two stabilization strap sections and the chin strap of the helmet shown in FIG. 3, wherein a lateral section of the stabilization strap is engaged with the chin strap.

The lateral section 48 of the stabilization strap 46 connects the front section 24 of the helmet shell 22, forwardly of the front branch 40 of the chin strap 32 to the rear branch 42 of the chin strap 32. More particularly, a first end 54 of the lateral section 48 is secured to the helmet shell 22 through a connector (FIG. 5). To adjust the angle and the location of the lateral section 48 of the stabilization strap 46, the first end 54 of the lateral section 48 is pivotally connected to the connector, as it will be described in more details below.

Figure 3:
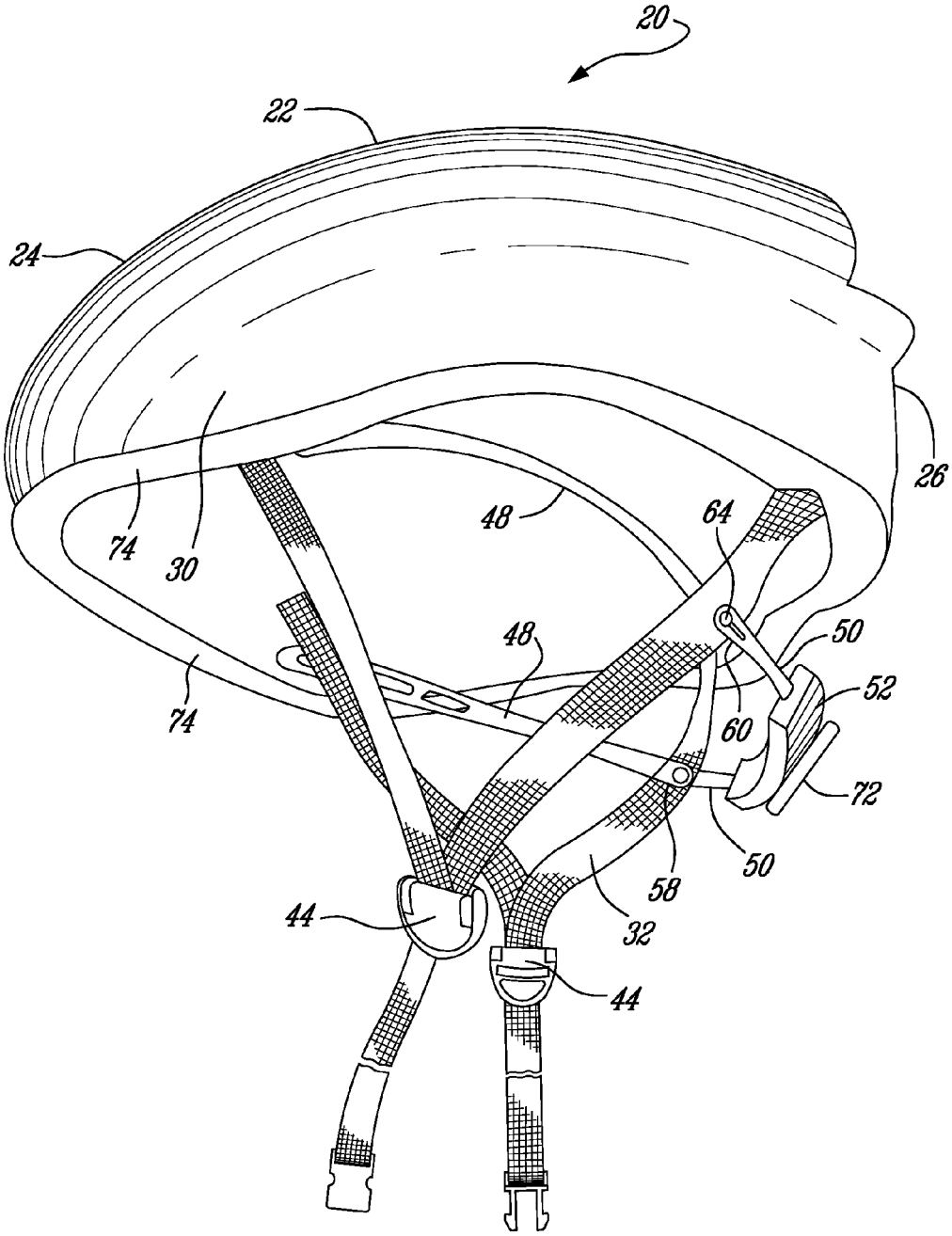
FIG. 3 is a bottom perspective view of the helmet having the stabilization strap shown in FIG. 1.
Figure 4:
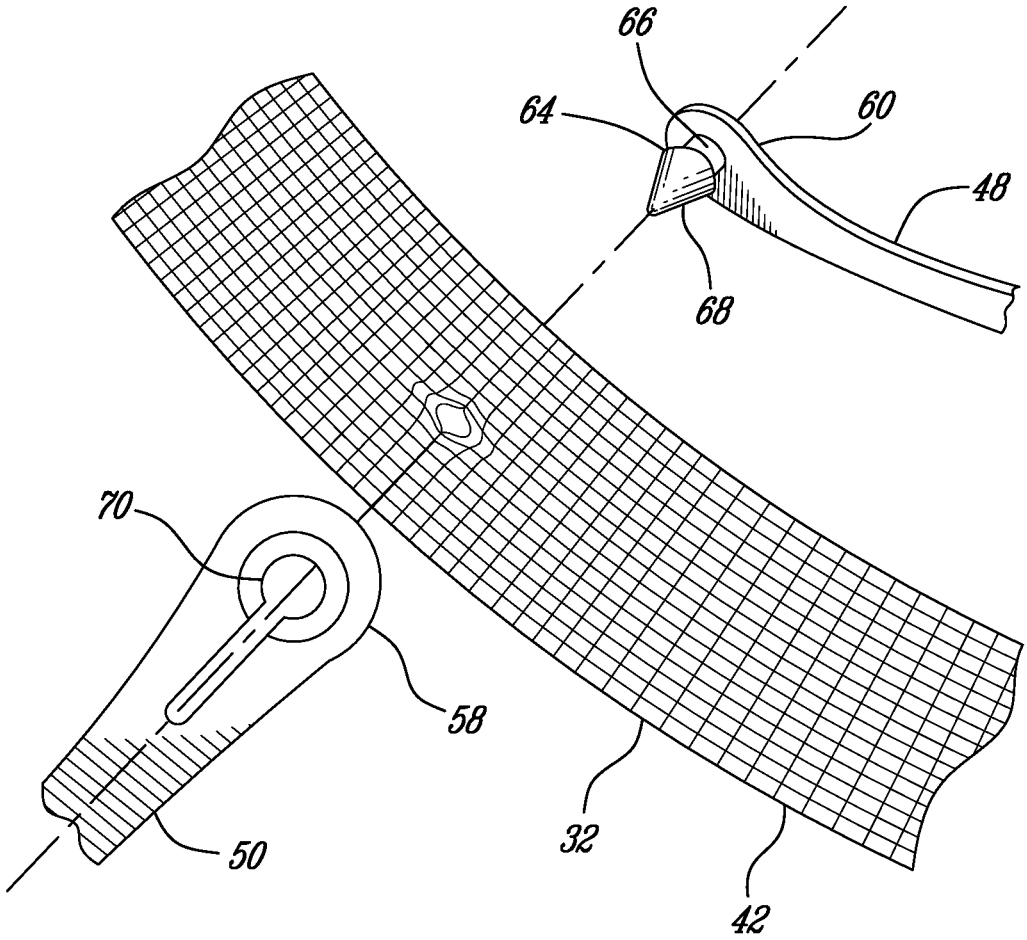
FIG. 4 is a perspective view, enlarged and exploded, of a connection between two stabilization strap sections and a chin strap of the helmet in accordance with an embodiment.

A second end 58 of the lateral section 48 is secured to the rear branch 42 of the chin strap 32, downwardly from the helmet shell 22 (FIGS. 3 and 4). The lateral section 48 extends under the front branch 40 of the chin strap 32, between the wearer's head and the front chin strap. In an embodiment, the second end 58 of the lateral section 48 is secured to the rear branch 42 of the chin strap 32 between approximately 30 and 120 millimeters below the junction of the rear branch 42 of the chin strap 32 and the helmet shell 22. To adjust the angle and the location of the lateral section 48 of the stabilization strap 46, the second end 58 of the lateral section 48 is also pivotally connected to the rear branch 42 of the chin strap 32, as it will be described in more details below.

The occipital section 50 of the stabilization strap 46 connects the rear branch 42 of the chin strap 32 and the lateral section 48 of the stabilization strap 46 to the adjusting assembly 52. More particularly, a first end 60 of the occipital section 50 of the stabilization strap 46 is pivotally connected to the rear branch 42 of the chin strap 32 and to the lateral section 48 of the stabilization strap 46, as it will be described in more details below. A second end (not shown) of the occipital section 50 of the stabilization strap 46 is slidably inserted in the adjusting assembly 52, as it will also be described in more details below.

Referring now to FIGS. 3 and 4, the connection between the lateral and the occipital sections 48, 50 of the stabilization strap 46 and the chin strap 32 will be described in further details.

The second end 58 of the lateral section 48 of the stabilization strap 46 has a male member 64 which is designed to be inserted into the chin strap 32, to extend therethrough and to engage the first end 60 of the occipital section 50 of the stabilization strap 46. In the embodiment shown in FIGS. 1 to 5, the male member 64 includes a stem portion 66 and a conically-shaped protuberance 68 protruding from the stem portion. The conically-shaped protuberance 68 is insertable into the woven fabric chin strap 32 without substantially damaging the fibers. More particularly, as shown in FIGS. 4 and 5, most fibers remain unbroken following the insertion of the male member 64 therebetween. In an embodiment, all fibers remain unbroken following the insertion of the male member 64 therebetween. The fibers close to the inserted male member 64 are displaced from their original and substantially parallel configuration to allow the passage of the male member 64 therebetween. Thus, mechanical properties of the chin strap 32 remain substantially unaffected by the insertion of the male member 64.

When inserted through the rear branch 42 of the chin strap 32, the conical protuberance 68 of the male member 64 protrudes on the opposite side of the chin strap 32 and engages a female member 70 provided in the first end 60 of the occipital section 50 of the stabilization strap 46. More particularly, the first end 60 of the occipital section 50 of the stabilization strap 46 includes a key shaped aperture with an elongated portion contiguous to a circular portion. This particular shape facilitates insertion of the female member 70 in the male member 64 without permanent deformation of the occipital section 50. The male member 64 is inserted in the key shaped aperture and secures the lateral and the occipital sections 48, 50 of the stabilization strap 46 to the rear branch 42 of the chin strap 32. More particularly, for attaching the lateral and the occipital sections 48, 50 together, the conical protuberance 68 is fully inserted in the key shaped aperture until it is entirely located on the opposite side of the occipital section 50. Disengagement of the male and female members 64, 70 is prevented since the base of the conical protuberance 68 is wider than the stem portion 66.

It is appreciated that in an alternative embodiment (not shown), the male member 64 can be located on the first end 60 of the occipital section 50 and the corresponding female member 70 can be located on the second end 58 of the lateral section 48. It is appreciated that the shape of the male and female members 64, 70 can differ from the one described above and shown in the figures.

The first end 60 of the occipital section 50 and the second end 58 of the lateral section 48 are pivotally connected to the rear branch 42 of the chin strap 32. Therefore, their position can be adjusted with respect to the helmet 20 and the wearer's head. Furthermore, in an alternative embodiment (not shown), the male and female members 64, 70 can be connected to the front branch 40 of the chin strap 32.

The first end 60 of the occipital section 50 and the second end 58 of the lateral section 48 are attached to the rear branch 42 of the chin strap 32, downwardly of the helmet shell 22. In an embodiment, the first end 60 of the occipital section 50 and the second end 58 of the lateral section 48 are secured between about 30 and 120 millimeters below the connection of the chin strap 32 and the helmet shell 22. In an embodiment, they are secured between about 40 and 90 millimeters below the connection of the chin strap 32 and the helmet shell 22 and in another embodiment, they are secured between about 50 and 80 millimeters below the connection of the chin strap 32 and the helmet shell 22. In an embodiment, the distance between a lower rim 74 of the helmet shell 22 and the junction of the first end 60 of the occipital section 50 and the second end 58 of the lateral section 48 with the chin strap 32 is about between 5 and 100 millimeters and, in an alternative embodiment between 10 and 20 millimeters.

It is appreciated that the connection between the chin strap 32, the lateral section 48, and the occipital section 50 can be adjusted in accordance with the helmet wearer's needs. For instance, the lateral section 48 and the occipital section 50 can be disconnected from the chin strap 32 and reconnected at another location along the chin strap to obtain a better fitting on the wearer's head including the stabilization of the helmet.

As mentioned above, the second end (not shown) of the occipital section 50 is slidably inserted in the adjusting assembly 52, which links together both occipital sections 50 of the stabilization strap 46. The adjusting assembly 52 provides the means to bring the occipital sections 50 of the stabilization strap 46 closer together or farther away from each other by operating an actuating mechanism 72 to adjust to the particular wearer's head size. This adjusting assembly 52 will not be further discussed since it is believed to be well known in the art.

By actuating the adjusting assembly 52, the stabilization strap 46 is either tighten or loosen. For instance, when the stabilization strap 46 is tighten rearwardly, the occipital and lateral sections 50, 48 are simultaneously tighten rearwardly. The rear branch 42 of the chin strap 32 is also pulled rearwardly since are the occipital and lateral sections 50, 48 are attached thereto. On the opposite, when the adjusting assembly 52 is loosen, the occipital and lateral sections 50, 48 as well as the rear branch 42 of the chin strap 32 are simultaneously loosen.

The position of the adjusting assembly 52 on the wearer's head is adjustable since the occipital sections 50 are pivotally connected to the retention system and, more particularly, to the rear branch 42 of the chin strap 32. Thus, the inclination of the adjusting assembly 52 can be adjusted in accordance with the wearer's needs.

Referring now to FIG. 5, the connection between the lateral section 48 of the stabilization strap 46 and the helmet shell 22 will be described in further details.

The first end 54 of the stabilization strap lateral section 48 is attached to the helmet shell 22 and, more particularly, inwardly thereof, and close to a lower rim 74 of the shell 22. As mentioned above, it can be secured through a helmet connector (not shown) mounted to an inner surface of the shell 22. In an embodiment, the helmet connector has a female member (not shown) such as an aperture defined therein. The helmet connector is located in the front section 24 of the helmet 20, forwardly of the junction between the front chin strap 40 and the helmet shell 22. The first end 54 of the lateral section 48 has a protruding male member (not shown). The male member of the lateral section 48 is designed to be insertable and securable in the corresponding female member defined in the helmet connector. The first end 54 of the lateral section 48 of the stabilization strap 46 is thus pivotally attached to the helmet shell 22. More particularly, the male member of the lateral section 48 can pivot in the female member defined in the helmet connector. Therefore its position can be adjusted with respect to the helmet 20 and the wearer's head.

In an embodiment, the helmet 20 can include recesses (not shown) in the protective material for insertion of the helmet connectors therein. Therefore, the helmet connectors can be partially or entirely encapsulated in the helmet protective material.

In alternative embodiments (not shown), it is appreciated that the lateral section 48 of the stabilization strap 46 can be connected to the helmet shell 22, rearwardly of the chin strap 32 or between the front and the rear branches 40, 42 of the chin strap 32, if any. Furthermore, the connection between the lateral section 48 of the stabilization strap 46 and the helmet shell 22 can be pivotal or fixed, i.e. non-pivotal. Furthermore, the lateral section 48 of the stabilization strap 46 can be secured directly to the helmet shell 22, without an intermediate helmet connector. For instance and without being limitative, the male member of the lateral section 48 can be inserted directly in the shell 22. Furthermore, the lateral section 48 of the stabilization strap 46 can be secured to an outer face of the helmet shell 22 or to the lower rim 74. The male and female members can be interchanged, i.e. the male member can be located on the helmet shell 22 and the corresponding female member can be defined in the lateral section 48 of the stabilization strap 46.

In alternative embodiments (not shown), it is appreciated that the second end 58 of the lateral section 48 can be secured to the front branch 40 of the chin strap 32 or any branch thereof if the chin strap 32 is not Y-shaped. Furthermore, if the chin strap 32 is Y-shaped, the lateral section 48 can extend under or over the front chin strap 40 if it is secured to the rear chin strap 42. On the opposite, if the lateral section 48 of the stabilization strap 46 is secured to the front chin strap 40, the occipital section 50 of the stabilization strap 46 can extend under or over the rear chin strap 42.

In an alternative embodiment, the stabilization strap 46 can include solely occipital sections 50, i.e. the stabilization strap 46 does not include lateral sections 48 and is not connected to the helmet shell 22. The opposite ends of the occipital sections 50 are respectively secured to the chin strap 32 and to the adjusting assembly 52.

It is appreciated that the shape of the male and female members 64, 70 located at the ends 58, 60 of the lateral and occipital sections 48, 50 of the stabilization strap 46 can differ from the one shown in the figures and described above. Furthermore, the connections between the lateral section 48 and the helmet shell 22 and between the lateral and occipital sections 48, 50 and the chin strap 32 can be fixed or pivotal connections.

In an alternative embodiment (not shown), the lateral and occipital sections 48, 50 of the stabilization strap 46 can be attached to the chin strap 32 with other fasteners such as and without being limitative a rivet. In another alternative embodiment (not shown), the ends 58, 60 of the lateral and occipital sections 48, 50 of the stabilization strap 46 can both have a female member and can be attached to the chin strap 32 with a male member insertable simultaneously in the female members of the lateral and occipital sections 48, 50 and in the chin strap 32. In a further alternative embodiment, the ends 58, 60 of the lateral and occipital sections 48, 50 of the stabilization strap 46 can both have a female member and can be attached to the chin strap 32 with their respective male member, i.e. each female member is secured to the chin strap 32 with one male member.

It is appreciated that the chin strap 32 can be pre-pierced, i.e. an aperture is created in the chin strap 32 before the attachment of the lateral and occipital sections 48, 50 thereto. To prevent unraveling of the chin strap 32, the aperture perimeter can be burned.

The size and the shape of the stabilization strap 46 and the adjusting assembly 52 may also vary from the one shown in the figures and described above. Furthermore, the configuration of the attachment between the various components of the stabilization strap 46 and the helmet 20 may vary and may be achieved by various types of fastening assemblies.

In an embodiment, the lateral and occipital sections 48, 50 of the stabilization strap 46 is made of flexible and resilient material, strong enough to sustain various types of stress. For instance and without being limitative, the lateral and occipital sections 48, 50 of the stabilization strap 46 can be made of plastic, nylon, debrin, acetal, polypropylene, and the like. However, it is appreciated that other appropriate materials can be used. It is appreciated that almost any relatively flexible material can be used for the lateral section 48 of the stabilization strap 46 while for the occipital sections 50, the material must be characterized by a relative stiffness.

The stabilization strap 46 and the adjusting assembly 52 are adjustable and securable in more than one predetermined angled position with respect to the helmet 20 and the wearer's head. The stabilization strap 46 is adjustable to conform to the size and shape of the wearer's head. It helps maintain and stabilize the position of the helmet 20 on the wearer's head.

The weight of the stabilization system is reduced since the thickness of the lateral and occipital sections of the stabilization straps can be thinner than with the prior stabilization systems.

In the above described embodiments, the stabilization system is used in combination with a cycling helmet. However, it is appreciated that the stabilization strap can be used for several types of helmets 20 where stabilization of the helmet on the wearer's head is required.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A helmet comprising a shell shaped to fit a wearer's cranium and having a left side and a right side;

at least one chin strap having a left section and a right section attached to the shell; and a stabilization strap including a left and a right lateral sections, each having a first end connected respectively to the left and the right sides of the shell and a second end attached respectively to the left and the right sides of the at least one chin strap, a left and a right occipital sections, each having a first end attached respectively to the left and the right sides of the at least one chin strap and a second end, and an adjusting assembly connecting the second ends of the left and the right occipital sections together.

2. A helmet as claimed in claim 1, wherein the second ends of the lateral sections are pivotally attached to a respective one of the first ends of the occipital sections.

3. A helmet as claimed in claim 2, wherein one of the second ends of the lateral sections and the first ends of the occipital sections comprises a female member and the other one of the second ends of the lateral sections and the first ends of the occipital sections comprises a corresponding male member insertable in the female member.

4. A helmet as claimed in claim 3, wherein the second ends of the lateral sections comprise the male members and the first ends of the occipital sections comprise the female members and wherein the male members comprise a stem portion and a conically shaped protuberance extending from the stem portion and the female members comprise an aperture defined in the first ends of the occipital sections.

5. A helmet as claimed in claim 1, wherein the second ends of the lateral sections and the first ends of the occipital sections are pivotally connected to the at least one chin strap.

6. A helmet as claimed in claim 1, wherein the left and the right sections of the at least one chin strap are substantially Y-shaped with a front branch attached to the shell and a rear branch attached to the shell in a spaced-apart relationship and the second ends of the lateral sections and the first ends of the occipital sections are attached to the rear branch of the at least one chin strap.

7. A helmet as claimed in claim 6, wherein the second ends of the lateral sections and the first ends of the occipital sections are attached to the rear branch downwardly of and spaced-apart from the shell.

8. A helmet as claimed in claim 1, wherein the second ends of the left and the right occipital sections are slidably connected to the adjusting assembly for adjusting the length of the occipital sections.

9. A helmet comprising a shell shaped to fit a wearer's cranium and having a left side and a right side;

at least one woven-fiber chin strap having a left section and a right section connected to the shell; and a stabilization strap including a left and a right occipital sections, each having a first end pivotally attached respectively to the left and the right sides of the at least one chin strap with a pivot stem inserted through the at least one woven-fiber chin strap without substantially creating discontinuities in the at least one woven-fiber chin strap, and a second end, and an adjusting assembly connecting the second ends of the left and the right occipital sections together.

10. A helmet as claimed in claim 9, wherein the stabilization strap comprises a left and a right lateral sections, each having a first end connected respectively to the left and the right sides of the shell and a second end attached respectively to the left and the right sides of the at least one chin strap.

11. A helmet as claimed in claim 10, wherein the second ends of the lateral sections are attached to a respective one of the first ends of the occipital sections.

12. A helmet as claimed in claim 11, wherein one of the second ends of the lateral sections and the first ends of the occipital sections comprises a female member and the other one of the second ends of the lateral sections and the first ends of the occipital sections comprises the pivot stems insertable in a corresponding one of the female member and in the at least one chin strap.

13. A helmet as claimed in claim 12, wherein the second ends of the lateral sections comprise the pivot stems and the first ends of the occipital sections comprise the female members and wherein the pivot stems each have a conically shaped protuberance extending from therefrom and the female members comprise an aperture defined in the first ends of the occipital sections.

14. A helmet as claimed in claim 10, wherein the second ends of the lateral sections are pivotally connected to the at least one chin strap.

15. A helmet as claimed in claim 10, wherein the left and the right sections of the at least one chin strap are substantially Y-shaped with a front branch attached to the shell and a rear branch attached to the shell in a spaced-apart relationship and the second ends of the lateral sections and the first ends of the occipital sections are attached to the rear branch.

16. A helmet as claimed in claim 15, wherein the second ends of the lateral sections and the first ends of the occipital sections are attached to the rear branch downwardly of and spaced-apart from the shell.

17. A helmet as claimed in claim 9, wherein the second ends of the left and the right occipital sections are slidably connected to the adjusting assembly.

18. A stabilization strap apparatus for a helmet having a casket shell with at least one chin strap having a left section and a right section connected to the shell, comprising:

an adjusting assembly shaped to fit a rear occipital portion of a wearer's cranium;

a left occipital strap section and a right occipital strap section, each strap section having a first end securable respectively to the left section and the right section of the at least one chin strap, downwardly of and spaced-apart from the casket shell and a second end slidably attached to the adjusting assembly; and a left lateral section and a right lateral section, each having a first end adapted to be connected respectively to the left and the right sides of the casket shell and a second end adapted to be attached respectively to the left and the right sides of the at least one chin strap.

19. A stabilization strap apparatus as claimed in claim 18, wherein the second ends of the lateral sections are attached to a respective one of the first ends of the occipital sections.

20. A stabilization strap apparatus as claimed in claim 19, wherein one of the second ends of the lateral sections and the first ends of the occipital sections comprises a female member and the other one of the second ends of the lateral sections and the first ends of the occipital sections comprises a corresponding male member insertable in the female member.

21. A stabilization strap apparatus as claimed in claim 18, wherein the second ends of the lateral sections and the first ends of the occipital sections are adapted to be pivotally connected to the at least one chin strap.

22. A stabilization strap apparatus as claimed in claim 18, wherein the left and the right sections of the at least one chin strap are substantially Y-shaped with a front branch attached to the shell and a rear branch attached to the shell in a spaced-apart relationship, and wherein the second ends of the lateral sections and the first ends of the occipital sections are adapted to be attached to the rear branch.

* * * * *